US007743847B2

(12) United States Patent
Fisher

(10) Patent No.: US 7,743,847 B2
(45) Date of Patent: Jun. 29, 2010

(54) CAM OPERATED DEVICES

(75) Inventor: Hugh Edward Fisher, Ayrshire (GB)

(73) Assignee: Wave Craft Limited (AE)

( * ) Notice: Subject to any disclaimer, the term of this patent is extended or adjusted under 35 U.S.C. 154(b) by 0 days.

(21) Appl. No.: 10/380,101

(22) PCT Filed: Aug. 13, 2001

(86) PCT No.: PCT/GB01/03631

§ 371 (c)(1),
(2), (4) Date: Aug. 21, 2003

(87) PCT Pub. No.: WO02/14028

PCT Pub. Date: Feb. 21, 2002

(65) Prior Publication Data

US 2004/0035595 A1 Feb. 26, 2004

(30) Foreign Application Priority Data

Aug. 15, 2000 (GB) ..... 0019919.0
May 15, 2001 (GB) ..... 0111786.0

(51) Int. Cl.
*B25D 15/02* (2006.01)

(52) U.S. Cl. ..... 173/205; 173/109; 173/128

(58) Field of Classification Search ..... 173/109, 173/104, 128, 205, 122, 124
See application file for complete search history.

(56) References Cited

U.S. PATENT DOCUMENTS 1,505,493 A * 8/1924 Roberts ..... 173/205
2,436,692 A * 2/1948 Greene ..... 74/57
3,049,803 A * 8/1962 Danger ..... 30/228
3,232,353 A * 2/1966 Schurmann ..... 172/107
3,256,946 A 6/1966 Jansen et al.
4,082,152 A 4/1978 Whitworth ..... 173/119
4,817,736 A 4/1989 Ono ..... 173/93
5,042,592 A * 8/1991 Fisher ..... 173/109
5,427,188 A * 6/1995 Fisher ..... 173/205
5,449,044 A * 9/1995 Phillips ..... 173/203
5,513,709 A * 5/1996 Fisher ..... 173/205
5,607,265 A * 3/1997 Lane ..... 408/20

(Continued)

FOREIGN PATENT DOCUMENTS

DE 1007148 4/1957

(Continued)

*Primary Examiner*—Scott A. Smith
(74) *Attorney, Agent, or Firm*—Gifford, Krass, Sprinkle, Anderson & Citkowski, P.C.

(57) ABSTRACT

A number of cam-operated devices such as power tools (10) are described, the tools having a rotary drive device (24) for rotating a drive shaft (36) having a cylinder cam (42) mounted thereon. A pair of cam followers (54) are located within a cam track (44) provided on the cam member (42), such that rotation of the cam (42) causes axial movement of the cam followers (54), which may be attached to a drive shaft (48) and a tool bit (12). A range of shapes of cam track (44) are described, each of which is non-sinusoidal in shape. Various embodiments of the invention provide non-sinusoidal cam tracks having forward or rearward throw sections which are respectively steeper, shorter, or provide greater acceleration of the cam followers than sinusoidal cam tracks of equivalent wavelength and amplitude. Related piston and cylinder devices and reciprocal drive devices are also described.

26 Claims, 3 Drawing Sheets

U.S. PATENT DOCUMENTS

| | | | | |
|---|---|---|---|---|
| 6,199,640 | B1 * | 3/2001 | Hecht | 173/48 |
| 6,368,324 | B1 * | 4/2002 | Dinger et al. | 606/85 |

FOREIGN PATENT DOCUMENTS

| | | | |
|---|---|---|---|
| FR | 969417 | | 12/1950 |
| GB | 442493 | | 2/1936 |
| GB | 2 219 958 | A | 6/1989 |
| WO | WO 9311910 | | 6/1993 |
| WO | WO 9323655 | | 11/1993 |

* cited by examiner

CAM OPERATED DEVICES

FIELD OF THE INVENTION

The present invention relates to cam operated devices. More particularly, though not exclusively the invention relates to cam operated power tools, and more particularly still to power tools with reciprocating tool bits driven by rotary drive means. The invention also relates more generally to a cam operated drive means for converting rotary motion to reciprocating motion, and to a cam operated drive means for converting reciprocating motion to rotary motion.

BACKGROUND OF THE INVENTION

A number of types of reciprocating power tools are in general use for various tasks, for example, saws, scrapers, hammers and the like. Commonly such tools are hydraulically or pneumatically powered; however, such power means necessitate the use of a noisy and bulky compressor or the like in conjunction with the tool itself, resulting in a limited range of utility of the tools, and such tools cannot easily or efficiently attain high speeds of reciprocation.

An alternative arrangement is to convert rotary movement provided by for example an electric motor into reciprocating movement of the tool bit. One means for achieving this conversion is to use the motor to drive the rotation of a cam bearing a sinusoidal cam track, and to provide the tool bit with a pair of cam followers which interact with the cam track. As the cam rotates, therefore, the cam followers will be driven forward and backward along the sinusoidal cam track, so driving the tool bit forward and backward. Such arrangements are described in previous patent applications GB 2 219 958A and W093/11910 by the same inventor, the contents of which are incorporated herein by reference.

While such arrangements have numerous advantages over pneumatically or hydraulically powered devices, it has until now been thought that provision of a sinusoidal cam track is an essential element of the invention.

International Patent Application WO93/23655 the contents of which are incorporated herein by reference, by the same inventor, describes a number of piston and cylinder devices wherein the piston is in the form of a cam member with a sinusoidal cam track in which are disposed a pair of fixed cam followers. Reciprocating movement of the piston (driven, for example, by combustion of a fuel in the chamber formed by the cylinder) is accompanied by a rotary motion imparted by the interaction of the cam followers and the cam track. The rotary motion may be used to drive an output member in a rotary action.

It is among the objects of embodiments of the present invention to obviate or alleviate disadvantages of the prior art.

It is further among the objects of embodiments of the present invention to provide a cam operated device which provides a greater acceleration of the member being driven on the forward and/or backward throw than that provided by prior art devices.

It is further among the objects of certain embodiments of the present invention to provide an electrically-driven reciprocating power tool which provides a greater impact velocity of the tool bit for a given power input than known electrically-driven reciprocating power tools.

SUMMARY OF THE INVENTION

According to a first aspect of the present invention, there is provided a power tool comprising a housing, a rotary drive means, a cylinder cam having a cam track extending around a circumferential surface thereof, cam follower means adapted to run in said cam track, and a mounting arrangement for a tool bit, one of the cam and the cam follower means being driven by the drive means, and the mounting arrangement being associated with one of the cam and the cam follower means, such that actuation of the rotary drive means drives reciprocal movement of the mounting arrangement; and wherein at least part of the cam track is in the form of a wave having an amplitude and a wavelength, the wave providing a forward throw section and a rearward throw section which in use drive the mounting arrangement respectively forward and rearward, at least one of the forward throw section or rearward throw section imparting a greater forward or rearward acceleration respectively to the mounting arrangement than that imparted by a sinusoidal cam track of equivalent amplitude and wavelength.

Preferably the forward throw section imparts a greater forward acceleration to the mounting arrangement than that imparted by a sinusoidal cam track. Alternatively, or in addition, the rearward throw section may impart a greater rearward acceleration to the mounting arrangement.

It has been unexpectedly found that a sinusoidal cam track is not essential for the performance of the present invention. A number of cam track shapes will provide a greater forward acceleration in use, this greater acceleration meaning that a tool bit will contact a surface with greater force than a conventional tool. This provides tools according to the present invention with a wider range of possible uses, and improved efficiency, over conventional tools. Further, although there will therefore be increased wear at the peaks of the cam track this unexpectedly does not decrease the effectiveness of the tool. It has been found that the cam followers will ricochet from the cam track peak to return along the rearward throw section almost regardless of the shape of the peak section, due to the increased force behind the cam followers. Therefore the cam track is able to tolerate increased wear over what was previously thought acceptable.

According to a further aspect of the present invention, there is provided a power tool comprising a housing, a rotary drive means, a cylinder cam having a cam track extending around a circumferential surface thereof, cam follower means adapted to run in said cam track, and a mounting arrangement for a tool bit, one of the cam and the cam follower means being driven by the drive means, and the mounting arrangement being associated with one of the cam and the cam follower means such that actuation of the rotary drive means drives reciprocal movement of the mounting arrangement; and wherein at least part of the cam track is in the form of a wave having an amplitude and a wavelength, the wave having a forward throw section and a rearward throw section which in use drive the mounting arrangement respectively forward and rearward, at least one of the forward throw section or rearward throw section being of a steeper gradient than the forward throw section or rearward throw section respectively of a sinusoidal cam track of equivalent amplitude and wavelength.

Preferably the forward throw section is of a steeper gradient than the forward throw section of a sinusoidal cam track. Alternatively or in addition the rearward throw section is of a steeper gradient.

Conveniently the cam track incorporates a substantially straight section. This may conveniently form part of the forward throw section. Alternatively, or in addition, the cam track may incorporate a straight section in the rearward throw section, and/or in the peak or trough sections. It has been found that not only does a straight forward throw section impart a relatively high forward acceleration to the tool bit, but also that if the speed of the cam followers is great enough, the followers will tend to move in a straight path anyway. In conventional sinusoidal cam tracks this tendency can lead to greater wear of the tracks at high speeds and/or accelerations; this is less of a problem where the cam track incorporates straight sections.

Conveniently the cam track is of a "truncated zig-zag" form; that is, substantially straight throw sections with substantially flat peaks and troughs. Alternatively, only the forward throw sections may be substantially straight, with the rearward throw section being curved.

The rearward throw section may be either steeper or less steep than that of an equivalent sinusoidal cam track. An advantage of providing a less steep rearward throw is that it provides a gentler "recovery" stroke for the tool bit, so enabling some of the additional energy from the forward stroke to be dissipated without causing excess wear to the cam track.

According to a further aspect of the present invention, there is provided a power tool comprising a housing, a rotary drive means, a cylinder cam having a cam track extending around a circumferential surface thereof, cam follower means adapted to run in said cam track, and a mounting arrangement for a tool bit, one of the cam and the cam follower means being driven by the drive means, and the mounting arrangement being associated with one of the cam and the cam follower means such that actuation of the rotary drive means drives reciprocal movement of the mounting arrangement; and wherein at least part of the cam track is in the form of a wave having an amplitude and a wavelength, the wave having a forward throw section and a rearward throw section which in use drive the mounting arrangement respectively forward and rearward, the length of at least one of the forward throw section or rearward throw section of the cam track being shorter than the length of the forward throw section or rearward throw section respectively of a sinusoidal cam track of equivalent amplitude and wavelength.

Preferably the forward throw section is shorter than the forward throw section of a sinusoidal cam track. Alternatively, or in addition the rearward throw section is shorter than that of a sinusoidal cam track.

According to a further aspect of the present invention, there is provided a power tool comprising a housing, a rotary drive means, a cylinder cam having a cam track extending around a circumferential surface thereof, cam follower means adapted to run in said cam track, and a mounting arrangement for a tool bit, one of the cam and the cam follower means being driven by the drive means, and the mounting arrangement being associated with one of the cam and the cam follower means such that actuation of the rotary drive means drives reciprocal movement of the mounting arrangement; and wherein at least part of the cam track is in the form of a non-sinusoidal wave.

The following comments apply, equally to all four aspects of the invention, unless otherwise indicated.

Preferably the cam track is of a regular waveform. Alternative embodiments of the invention may however provide an irregular cam track, for example, alternating one cycle of a long wavelength with one cycle of a shorter wavelength. Such irregular (or "disharmonic") cycles may be of benefit in setting up vibrations in a work surface which may assist the effects of the tool.

The cam track may comprise one or more wavelengths of the waveform; the number of wavelengths selected depending on the desired purpose of the power tool. An increased number of wavelengths in the cam track will provide more frequent reciprocation of the mounting arrangement.

Conveniently, the cam may be selected from a plurality of cam members having a range of cam throw distances.

Preferably, the rotary drive means is a motor; more preferably an electric motor. Conveniently the motor may be powered by mains electricity using a transformer, or by batteries. If desired, the batteries may be of the rechargeable type or may be replaceable. Alternatively, any other suitable drive means may be used. Numerous possibilities will occur to the person of skill in the art, for example, hydraulic, pneumatic, clockwork, steam powered and the like.

The rotary drive means may, in use, drive the cylinder cam directly, in which case the mounting arrangement is associated with the cam follower means. Alternatively, the drive means may drive the cam follower means, which will therefore reciprocate the cam. The mounting arrangement is then associated with the cylinder cam.

The tool may further comprise a cooling arrangement to cool the drive means: for example, openings in the housing may provide air flow; a fan may be incorporated; or a fluid flow cooling arrangement may be utilised. It has been found that smaller tools according to the present invention (that is, of a size compatible with being used as portable hand held tools) use little enough power while still providing an acceptable reciprocal tool bit movement to be cooled satisfactorily merely by heat radiation from the casing. Therefore, such portable tools may be substantially sealed. Conveniently in such examples the tool may be used as a marine growth remover, for scraping marine growth from boat hulls and the like. However, sealed portable power tools may also find many other applications in damp or moist environments, or in other hazardous environments, for example, gas or petrol-fume filled areas.

The cam may be user-changeable, either separately or together with the tool bit mounting arrangement. A user may select a cam with a specific cam track arrangement for a particular tool bit or purpose (depending, for example, on where the greatest acceleration of the bit is required; or on the number of cycles per turn of the cam). Alternatively or in addition cams may be replaceable to take account of wear. Thus, a tool may be produced with a cam specified to last a certain period of use; as the cam becomes worn, a user may periodically replace the cam with a new one.

One or more cam followers may be provided. Preferred embodiments of the invention provide two cam followers, although alternative embodiments may provide fewer or more cam followers, depending on the specific application.

Preferably the cam follower means is adapted to loosely run in the cam track. This provides a degree of "play" in the cam follower movement, which allows the tool to absorb some of the excess energy of the tool bit, and allow freer movement of the tool bit and cam.

Preferably the cam followers are rotatably mounted on a mounting. This enables the followers to rotate as they move along the cam track, effectively "running round" the track. This serves to further reduce wear on the track and followers.

According to a further aspect of the present invention, there is provided a cylindrical cam member for use in a power tool, the cam member having a cam track extending around a circumferential surface thereof, wherein at least part of the cam track is in the form of a wave having an amplitude and a wavelength, the wave having a forward throw section and a rearward throw section, at least one of the forward throw section or the rearward throw section being of a shorter length than the length of a forward throw section or rearward throw section respectively of a sinusoidal cam track of equivalent amplitude and wavelength.

Preferably the forward throw section is shorter than the forward throw section of a sinusoidal cam track. Alternatively or in addition the rearward throw section is shorter.

According to a further aspect of the present invention, there is provided a cylindrical cam member for use in a power tool, the cam member having a cam track extending around a circumferential surface thereof, wherein at least part of the cam track is in the form of a wave having an amplitude and a wavelength, the wave having a forward throw section and a rearward throw section, at least one of the forward throw section or the rearward throw section being of a steeper gradient than a forward throw section or rearward throw section respectively of a sinusoidal cam track of equivalent amplitude and wavelength.

Preferably the forward throw section is steeper. Alternatively or in addition the rearward throw section is steeper.

According to a further aspect of the present invention, there is provided a cylindrical cam member for use in a power tool, the cam member having a cam track extending around a circumferential surface thereof, wherein at least part of the cam track is in the form of a non-sinusoidal wave.

According to a yet further aspect of the present invention, there is provided a reciprocal drive means for driving a member in a reciprocating movement, the drive means comprising a rotary drive means, a cylinder cam driven by the rotary drive means, the cam having a cam track extending around a circumferential surface thereof, cam follower means adapted to run in said cam track, and a mounting arrangement for a member to be driven, the mounting arrangement being associated with the cam follower means such that rotation of the cam drives reciprocal movement of the mounting arrangement; and wherein at least part of the cam track is in the form of a wave having an amplitude and a wavelength, the wave having a forward throw section and a rearward throw section, at least one of the forward throw section or the rearward throw section being shorter than the length of the forward throw section or rearward throw section respectively of a sinusoidal cam track of equivalent amplitude and wavelength.

Preferably the forward throw section is shorter. Alternatively or in addition the rearward throw section is shorter.

According to a yet further aspect of the present invention, there is provided a reciprocal drive means for driving a member in a reciprocating movement, the drive means comprising a rotary drive means, a cylinder cam driven by the rotary drive means, the cam having a cam track extending around a circumferential surface thereof, cam follower means adapted to run in said cam track, and a mounting arrangement for a member to be driven, the mounting arrangement being associated with the cam follower means such that rotation of the cam drives reciprocal movement of the mounting arrangement; and wherein at least part of the cam track is in the form of a wave having an amplitude and a wavelength, the wave having a forward throw section and a rearward throw section, at least one of the forward throw section or the rearward throw section being of a steeper gradient than a forward throw section or rearward throw section respectively of a sinusoidal cam track of equivalent amplitude and wavelength.

Preferably the forward throw section is steeper. Alternatively or in addition the rearward throw section is steeper.

The reciprocal drive means of this and the preceding aspect of the present invention are suitable for use in a power tool, although the drive means is not limited to use therein. The drive means may find application in any situation requiring a reciprocal drive means, for example, motors, robots, scientific instruments, vehicles, and so forth.

According to a further aspect of the present invention, there is provided a piston and cylinder device comprising a cylinder, said cylinder including a chamber at least partially defined by an interior surface of said cylinder, at least one piston having an exterior cylindrical surface, said piston being adapted to partake of a motion having a component of movement lengthwise of the cylinder and an output member adapted to rotate about a lengthwise extending axis thereof, wherein there are provided cam means comprising a first cam part and a second cam part, one of said cam parts being a cam track arrangement formed in one of said surfaces and the other of said cam parts being a cam follower means formed on the other one of said surfaces and adapted to engage said track arrangement, the construction and operation being such that said cam means operates to impart to the motion of the piston a rotational component of movement and such that rotary motion produced in the output member is derived from said rotary component of movement of the piston motion, where at least part of the cam track is in the form of a wave having an amplitude and a wavelength, the wave having a forward throw section and a rearward throw section, at least one of the forward throw section and the rearward throw section being of a steeper gradient than the forward throw section or rearward throw section respectively of a sinusoidal cam track of equivalent amplitude and wavelength.

Preferably the forward throw section is steeper. Alternatively or in addition the rearward throw section is steeper.

According to a further aspect of the present invention, there is provided a piston and cylinder device comprising a cylinder, said cylinder including a chamber at least partially defined by an interior surface of said cylinder, at least one piston having an exterior cylindrical surface, said piston being adapted to partake of a motion having a component of movement lengthwise of the cylinder and an output member adapted to rotate about a lengthwise extending axis thereof, wherein there are provided cam means comprising a first cam part and a second cam part, one of said cam parts being a cam track arrangement formed in one of said surfaces and the other of said cam parts being a cam follower means formed on the other one of said surfaces and adapted to engage said track arrangement, the construction and operation being such that said cam means operates to impart to the motion of the piston a rotational component of movement and such that rotary motion produced in the output member is derived from said rotary component of movement of the piston motion, where at least part of the cam track is in the form of a wave having an amplitude and a wavelength, the wave having a forward throw section and a rearward throw section, the length of at least one of the forward throw section and the rearward throw section being shorter than the length of the forward throw section or rearward throw section respectively of a sinusoidal cam track of equivalent amplitude and wavelength.

Preferably the forward throw section is shorter. Alternatively or in addition the rearward throw section is shorter.

According to a further aspect of the present invention, there is provided a piston and cylinder device comprising a cylinder, said cylinder including a chamber at least partially defined by an interior surface of said cylinder, at least one piston having an exterior cylindrical surface, said piston being adapted to partake of a motion having a component of movement lengthwise of the cylinder and an output member adapted to rotate about a lengthwise extending axis thereof, wherein there are provided cam means comprising a first cam part and a second cam part, one of said cam parts being a cam track arrangement formed in one of said surfaces and the other of said cam parts being a cam follower means formed on the other one of said surfaces and adapted to engage said track arrangement, the construction and operation being such that said cam means operates to impart to the motion of the piston a rotational component of movement and such that rotary motion produced in the output member is derived from said rotary component of movement of the piston motion, where at least part of-the cam track is in the form of a non-sinusoidal wave.

The piston and cylinder device of this and the preceding two aspects of the invention may find application in numerous situations, for example, driving power tools, vehicles, motors, robotic vehicles, and such like.

It will be understood that certain embodiments of any of the aspects of the present invention may find application in the oil, gas, and petrochemical extraction and exploration industries, as well as in numerous other fields such as previously described. For example, power tools according to certain aspects of the invention may be used as drilling or boring apparatus for creation of boreholes in the petrochemical industry, among other purposes.

BRIEF DESCRIPTION OF THE DRAWINGS

These and other aspects of embodiments of the present invention will now be described by way of example only and with reference to the accompanying figures, in which.

DETAILED DESCRIIPTION OF THE PREFERRED EMBODIMENTS

Figure 1:
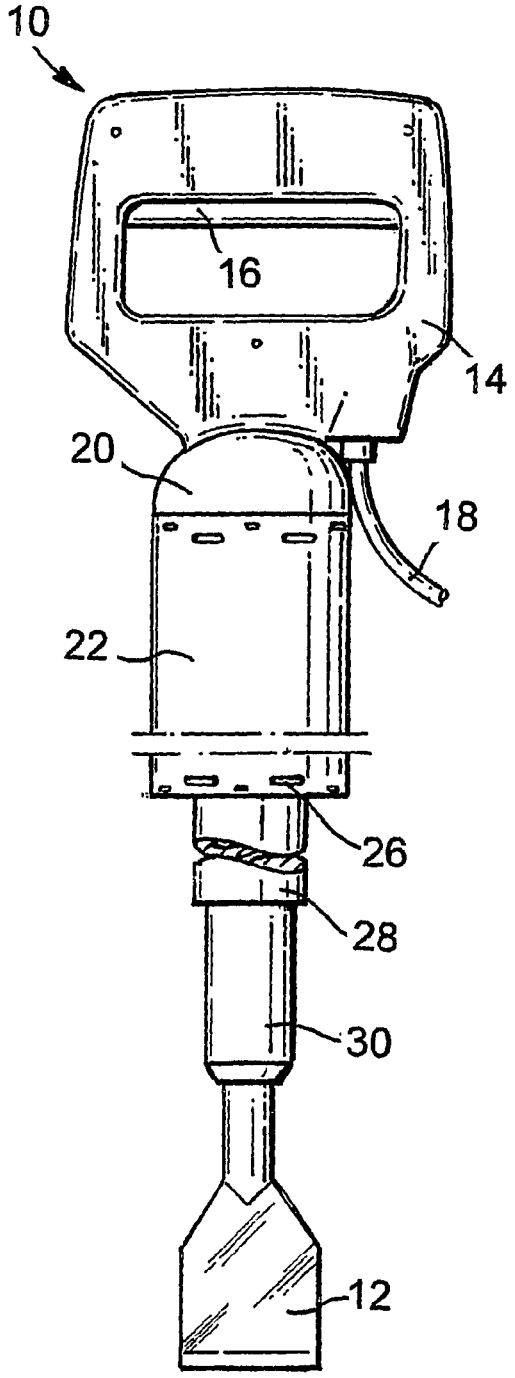
FIG. 1 is an external view of a tool according to the invention.

Referring first of all to FIG. 1, this shows a tool 10 according to the invention suitable for use with a variety of tool bits, but illustrated in the present example in use with a chisel bit 12.

The tool 10 comprises a handle 14 incorporating a trigger grip 16 operating the power supply through a cable 18. Alternative embodiments of the invention may provide a power supply by means of batteries, clockwork, or solar power. The handle is secured to a dome-shaped end cap 20 of a housing 22 for an electric motor 24 (FIG. 2.).

The housing 22 is provided with ventilation slots 26 and may be constructed as a long or short housing, according to the end use. A tubular casing 28 extends from the housing and from the casing projects a retaining collar 30 secured to a drive shaft to be described below, in which collar the tool bit 12 is mounted.

Figure 2:
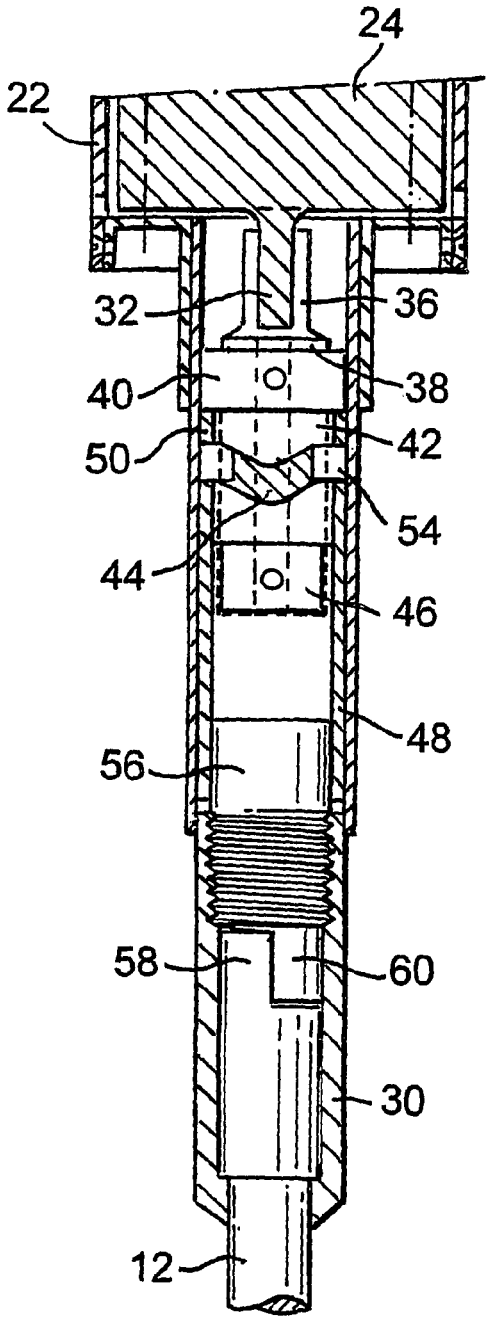
FIG. 2 is a longitudinal section through an intermediate portion of the tool of FIG. 1, to an enlarged scale.

Referring now to FIG. 2, the construction of the device is as follows. An output shaft 32 from the motor 24 is provided with two flats for entry into a shaped recess of a subshaft 36, a collar 38 of which abuts against a thrust bearing 40 in which the subshaft 36 is mounted. The thrust bearing 40 is secured to the casing 28.

Figure 3:
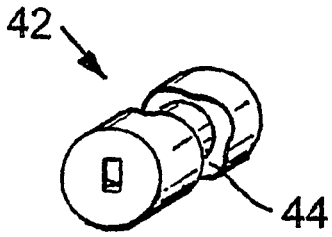
FIG. 3 is a perspective view of a cylinder cam.

Mounted on the subshaft 36 for rotation therewith is a cylinder cam 42 (illustrated in FIG. 3) with a circumferentially arranged cam track 44. The shape and nature of the cam track will be described below. The lower end of the subshaft 36 is mounted in a second thrust bearing 46.

Figure 4:
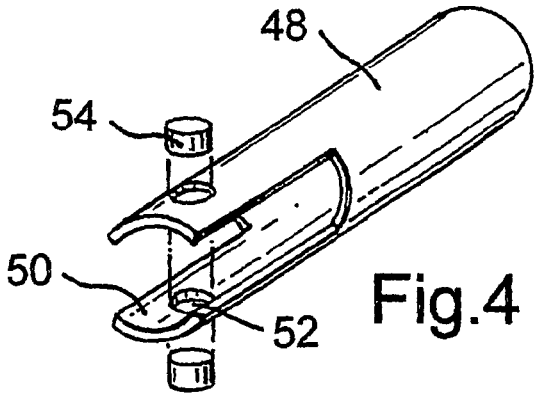
FIG. 4 is a perspective view of a drive shaft of the tool.

A hollow drive shaft 48 (illustrated in FIG. 4) is provided with two opposed extension portions 50, which lie adjacent the cam member 42. Each extension portion 50 is provided with an aperture 52 in which is received a stud 54 adapted for rotation within the aperture and which projects inwardly from the extension portions 50 into the cam track 44 of the cylinder cam 42.

Figure 5:
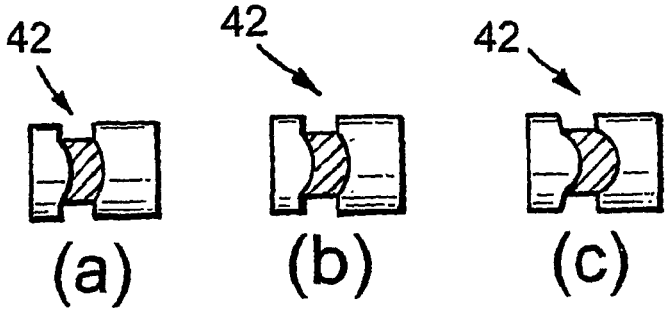
FIGS. 5*a-c* shows a range of cylinder cams.

Rotation of the cam 42 by the motor therefore causes the studs 54 to move axially with respect to the centre axis of the tool, and this causes the drive shaft 48 to move axially in a reciprocating manner. The stroke of the reciprocating movement is determined by the throw of the cam track, which may be selected from, for example, the range of cams 42, 42' and 42" shown in FIGS. 5*a-c*, i.e. 2 mm, 4 mm and 6 mm respectively.

An end piece 56 secured in the lower end of the drive shaft 50 is externally threaded to receive the bit retaining collar 30 which surrounds a tool bit, in the present example the chisel bit 12. The upper end portion of the bit 12 is step-contoured at 58 to engage with a complementary step 60 on the end piece 56.

It will be understood that the power tool is principally intended for small scale use, for example as a cold chisel, or as a spade; but may also be used in a smaller form as a hand-held tool, for example, for scraping or stripping paint, wallpaper or the like.

Figure 6:
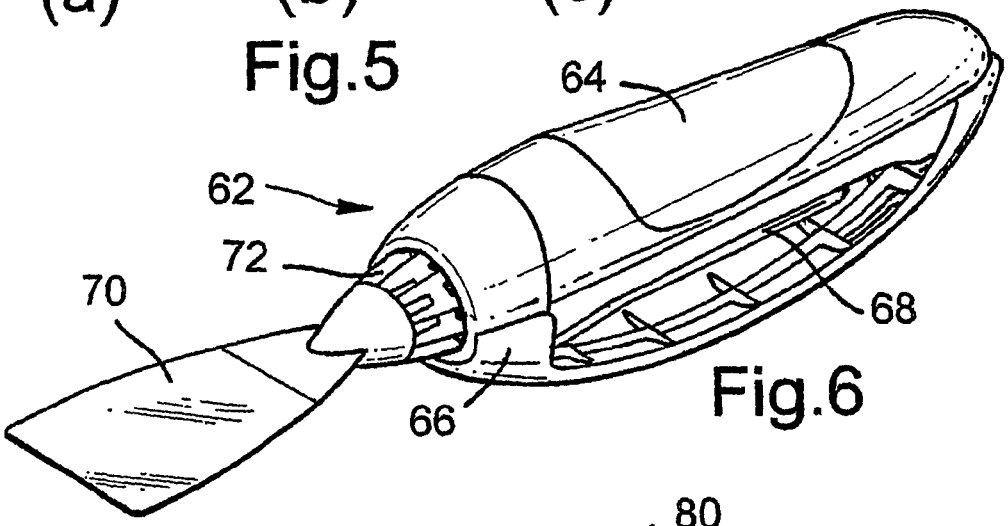
FIG. 6 shows an external view of an alternative tool according to the invention.

An alternative embodiment of a power tool according to the invention is shown in FIG. 6. This shows an external view of a marine growth remover, for removing barnacles and the like from ship hulls. The tool 62 includes a body 64 with a finger guard 66, which protects a trigger action operating switch 68. A reciprocating scraper blade 70 is received in a retaining collar 72. This tool is battery operated, and is sealed from water ingress by a rubber membrane (not shown), so the tool may be safely used underwater.

Figure 7:
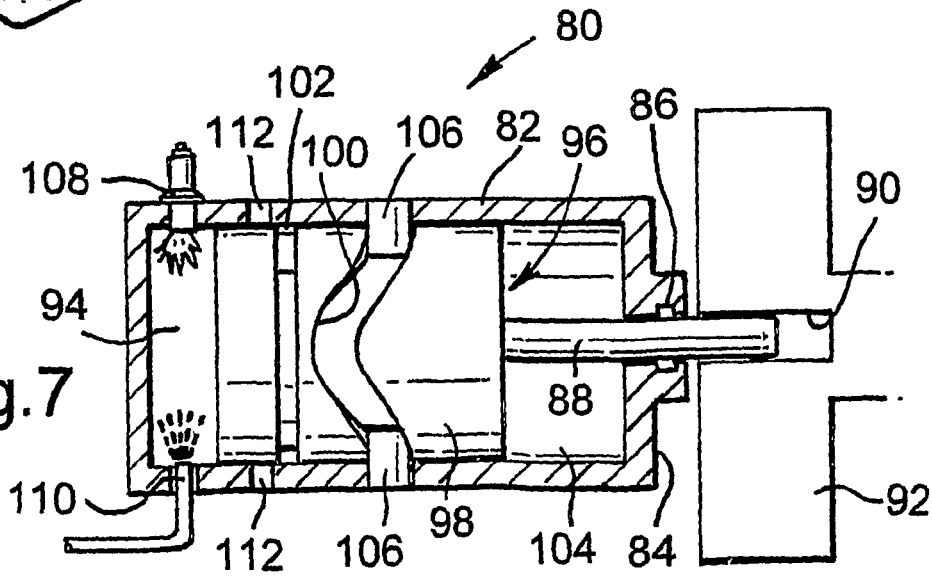
FIG. 7 shows a piston and cylinder device in accordance with an embodiment of the invention.

A piston and cylinder device in accordance with one embodiment of the invention is shown in FIG. 7. The device 80 comprises a hollow cylinder 82 one end wall 84 of which is provided with an aperture having bearings 86 through which projects an output shaft 88 sliding received in an axial slot 90 of a flywheel 92. Relative rotary movement between the shaft 88 and the flywheel 92 is prevented by keying splines (not shown). Received within a chamber 94 of the cylinder 82 is a piston 96 to which an inner end portion of the shaft 88 is connected. The piston has an exterior cylindrical surface 98 in which is formed a cam track 100 providing a path in the form of a wave and having two lobes.

A compression sealing ring 102 is provided in an annular groove around the piston 96 in the region of an opposite end face to that connected to the shaft 88, the ring acting also as a scraper device against a portion of an interior surface 104 of the cylinder from which project two cam followers 106. The cam followers 106 may be in the form of studs or bosses, or cylindrical roller members as shown. Such rollers will require a substantially rectangular cross-section cam track but a domed stud or boss may be used with a U-shaped track.

As viewed in FIG. 7, there is provided at the left-hand end portion of the chamber 94, a spark plug 108 and an injection nozzle 110 for the provision of a fuel/oil mixture arranged to operate a two-stroke internal combustion cycle. FIG. 7 shows the position of the piston 96 as the plug 108 sparks to ignite the fuel delivered by the nozzle 110. As the piston is impelled to the right, the action of the cam followers 106 in the track 100 causes the piston to partake of a motion having not only a lengthwise component of movement but also a rotary component. The extent of lengthwise movement is limited by the throw of the cam track.

It will thus be appreciated that the piston motion comprises a rotational movement of 180° for each operation of the spark plug 108 and includes a short lengthwise movement. The output shaft 88 thus partakes of a similar short travel motion. However the shaft 88 is splined into the axial slot 90 for sliding movement and therefore only the rotational component of movement is transmitted to the flywheel. The provision of a non-sinusoidal cam track, with a steeper forward throw than that of a sinusoidal track, provides a greater initial acceleration to the flywheel than known prior art devices.

Figure 8:
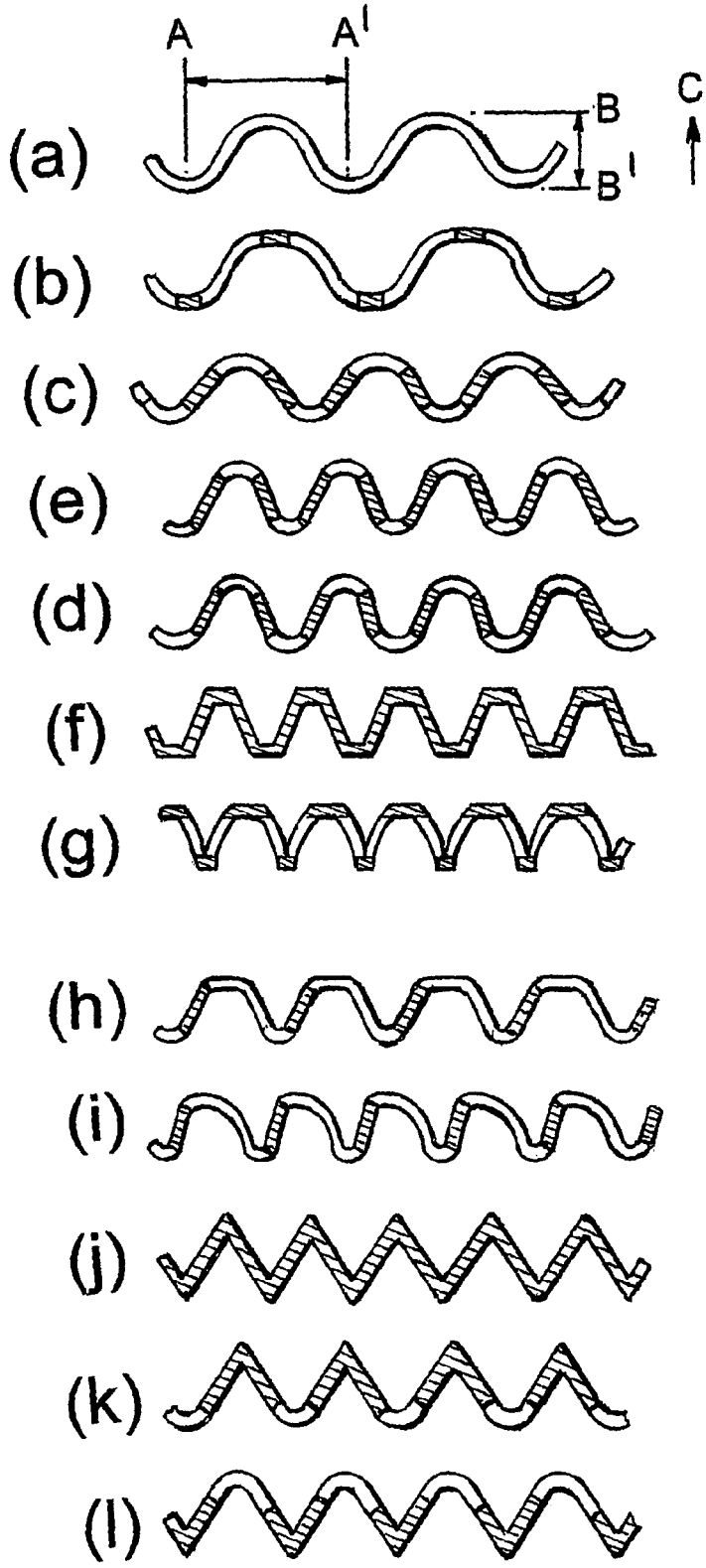
FIGS. 8*a-l* shows various curve shapes as may be used as cam tracks in embodiments of the present invention.

Referring now to FIG. 8, this shows a number of alternative cam track shapes as may be used with the tool of FIGS. 1 and 6, or with the piston and cylinder device of FIG. 7. For clarity, straight sections of the curves are shown as hatched boxes, while curved section are shown as open boxes.

Curve (a) is a standard sinusoidal curve, as is known from the prior art. Various regions of the curve are designated as follows. The distance A-A' is the wavelength of the curve, as well as defining the repeating unit. The distance B-B' is the amplitude of the curve, being the vertical height between the peak B and trough Be. The portion of the curve from point A to the first peak is the forward throw section, while the portion from that peak to the point A' is the rearward throw section. The direction of forward movement in use is illustrated by arrow C.

Curve (b) illustrates part of a sinusoidal curve but with flattened peaks and troughs. This curve provides a greater acceleration to a tool blade on both forward and reverse throws than a sine curve of the same amplitude and frequency. This curve (b) is in effect part of a sine curve of greater amplitude and the same frequency wherein the peaks and troughs are flattened. The flattened peaks and troughs also allow the cam followers to bounce off the peaks and troughs without closely following the line of the curve.

Curve (c) has straight sections on both forward and reverse throws. These sections are steeper than the equivalent sections of a sine curve. A variant is given by curve (d), which has longer straight throw sections.

Curve (e) also provides straight forward and rearward throws, while also having more tightly curved peaks and less curved troughs. Thus, while a tool bit will rapidly ricochet from the peaks, so hitting its substrate with greater force, the blade will more gradually reverse direction at the troughs, so avoiding too much "kickback" in the user's hands.

Curve (f) is a combination of curves (b) and (d), being composed entirely of straight sections; while curve (g) has more curved sides than (f), which are still steeper than those of a sine curve.

Curves (h) and (i) provide straight forward throws, with curved rearward throws, so providing the tool bit with greater forward force than rearward.

Curve (j) provides straight forward and rear throws with angled peaks and troughs, which allow the cam follower to bounce off the ends of the track, and so rapidly change direction. Curves (k) and (l) are similar to curve (j), but provide either curved peaks or curved troughs, allowing a longer recovery period for the cam followers.

As illustrated by the curves (a)-(h) and (j)-(l), the alternative cam track shapes can include the form a wave that is symmetrical about the peak B and/or the trough B'.

It will be apparent to the person of skill in the art that numerous modifications may be made to the tools herein described without departing from the scope of the invention. In particular, various alternative curve shapes may be utilised other than those described, while still retaining the advantages of the invention.

The invention claimed is:

1. A power tool comprising a housing, a rotary drive means, a cylinder cam having a longitudinal axis of rotation and a cam track extending around a circumferential surface of the cylinder cam, the cam track having first and second opposing cam surfaces, cam follower means adapted to run in said cam track between said first and second cam surfaces, and a mounting arrangement for a tool bit, one of the cam surfaces and the cam follower means being driven by the drive means, and the mounting arrangement being associated with the other of the cam surfaces and the cam follower means, such that actuation of the rotary drive means drives reciprocal movement of the mounting arrangement along said longitudinal axis; and wherein at least part of the cam track formed by said first and second cam surfaces is in the form of a wave having an amplitude and a wavelength, the wave having straight portions, curved portions and providing a forward throw section and a rearward throw section which in use drive the mounting arrangement respectively forward and rearward, at least one of the forward throw section or rearward throw section imparting a greater forward or rearward acceleration respectively to the mounting arrangement than that imparted by a sinusoidal cam track of equivalent amplitude and wavelength.

2. The power tool of claim 1, wherein the forward throw section imparts a greater forward acceleration to the mounting arrangement than that imparted by a sinusoidal cam track of equivalent amplitude and wavelength.

3. The power tool of claim 1 wherein the rearward throw section imparts a greater rearward acceleration to the mounting arrangement than that imparted by a sinusoidal cam track of equivalent amplitude and wavelength.

4. The power tool of claim 1, wherein the cam track is of a regular waveform.

5. The power tool of claim 1, wherein the rotary drive means is a motor.

6. The power tool of claim 5, wherein the motor is an electric motor.

7. The power tool of claim 1, wherein, in use, the rotary drive means drives the cylinder cam directly, and the mounting arrangement is associated with the cam follower means.

8. The power tool of claim 1, further comprising a cooling arrangement to cool the drive means.

9. The power tool of claim 1, wherein two cam followers are provided.

10. The power tool of claim 1, wherein the cam follower means is adapted to loosely run in the cam track.

11. A power tool according to claim 1, wherein the circumferential surface of the cylinder cam around which the cam track extends is an outer facing surface such that the cam follower means are disposed radially inwards.

12. A power tool according to claim 1, wherein the cam follower means comprise two opposing cam follower members.

13. The power tool of claim 1, wherein the straight portions are flattened portions at peaks and troughs of the wave.

14. A power tool comprising a housing, a rotary drive means, a cylinder cam having a longitudinal axis of rotation and a cam track extending around a circumferential surface of the cylinder cam, the cam track having first and second opposing cam surfaces, cam follower means adapted to run in said cam track between said first and second cam surfaces, and a mounting arrangement for a tool bit, one of the cam surfaces and the cam follower means being driven by the drive means, and the mounting arrangement being associated with the other of the cam surfaces and the cam follower means, such that actuation of the rotary drive means drives reciprocal movement of the mounting arrangement along said longitudinal axis; and wherein at least part of the cam track formed by said first and second cam surfaces is in the form of a wave having an amplitude and a wavelength, the wave having straight portions, curved portions and a forward throw section and a rearward throw section which in use drive the mounting arrangement respectively forward and rearward, at least one of the forward throw section or rearward throw section being of a steeper gradient than the forward throw section or rearward throw section respectively of a sinusoidal cam track of equivalent amplitude and wavelength.

15. The power tool of claim 14, wherein the forward throw section is of a steeper gradient than the forward throw section of a sinusoidal cam track of equivalent amplitude and wavelength.

16. The power tool of claim 14, wherein the rearward throw section is of a steeper gradient than the rearward throw section of a sinusoidal cam track of equivalent amplitude and wavelength.

17. The power tool of claim 14, wherein the straight portions form part of the peak or trough sections of the cam track.

18. The power tool of claim 14, wherein, in use, at least one of the forward throw section or rearward throw section imparts a greater forward or rearward acceleration respectively to the mounting arrangement than that imparted by a sinusoidal cam track of equivalent amplitude and wavelength.

19. The power tool of claim 18, wherein the cam follower means is adapted to loosely run in the cam track.

20. The power tool of claim 14, wherein the cam follower means is adapted to loosely run in the cam track.

21. A power tool comprising a housing, a rotary drive means, a cylinder cam having a longitudinal axis of rotation and a cam track extending around a circumferential surface of the cylinder cam, the cam track having first and second opposing cam surfaces, cam follower means adapted to run in said cam track between said first and second cam surfaces, and a mounting arrangement for a tool bit, one of the cam surfaces and the cam follower means being driven by the drive means, and the mounting arrangement being associated with the other of the cam surfaces and the cam follower means, such that actuation of the rotary drive means drives reciprocal movement of the mounting arrangement along said longitudinal axis; and wherein at least part of the cam track formed by said first and second cam surfaces is in the form of a wave having an amplitude and a wavelength, the wave having straight portions, curved portions and a forward throw section and a rearward throw section which in use drive the mounting arrangement respectively forward and rearward, the length of at least one of the forward throw section or rearward throw section of the cam track being shorter than the length of the forward throw section or rearward throw section respectively of a sinusoidal cam track of equivalent amplitude and wavelength.

22. The power tool of claim 21, wherein the forward throw section is shorter than the forward throw section of a sinusoidal cam track of equivalent amplitude and wavelength.

23. The power tool of claim 21, wherein the rearward throw section is shorter than that of a sinusoidal cam track of equivalent amplitude and wavelength.

24. The power tool of claim 21, wherein the straight portions are flattened portions at peaks and troughs of the wave.

25. A power tool comprising a housing, a rotary drive, a cylinder cam having a longitudinal axis of rotation and a cam track extending around a circumferential surface of the cylinder cam, the cam track having first and second opposing cam surfaces, cam follower means adapted to run in said cam track between said first and second cam surfaces, and a mounting arrangement for a tool bit, one of the cam surfaces and the cam follower means being driven by the drive means, and the mounting arrangement being associated with the other of the cam surfaces and the cam follower means, such that the actuation of the rotary drive means drives reciprocal movement of the mounting arrangement along said longitudinal axis; and wherein at least part of the cam track formed by said first and second cam surfaces is in the form of a wave that is symmetrical about a peak of the wave and having an amplitude and a wavelength, the wave providing peaks, troughs, or peaks and troughs that are straight portions with curved portions therebetween, a forward throw section and a rearward throw section which in use drive the mounting arrangement respectively forward and rearward, at least one of the forward throw section or rearward throw section imparting a greater forward or rearward acceleration respectively to the mounting arrangement than that imparted by a sinusoidal cam track of equivalent amplitude and wavelength.

26. A power tool comprising a housing, a rotary drive means, a cylinder cam having a longitudinal axis of rotation and a cam track extending around a circumferential surface of the cylinder cam, the cam track having first and second opposing cam surfaces, cam follower means adapted to run in said cam track between said first and second cam surfaces, and a mounting arrangement for a tool bit, one of the cam surfaces, and the cam follower means being driven by the drive means, and the mounting arrangement being associated with the other of the cam surfaces and the cam follower means such that actuation of the rotary drive means drives reciprocal movement of the mounting arrangement along said longitudinal axis; and wherein at least part of the cam track formed by said first and second cam surfaces is in the form of a wave that is symmetrical about a peak of the wave and having an amplitude and a wavelength, the wave that is symmetrical about the peak having peaks, troughs, or peaks and troughs that are straight portions with curved portions therebetween, a forward throw section and a rearward throw section which in use drive the mounting arrangement respectively forward and rearward, the length of at least one of the forward throw section or rearward throw section of the cam track being shorter than the length of the forward throw section or rearward throw section respectively of a sinusoidal cam track of equivalent amplitude and wavelength.

* * * * *

UNITED STATES PATENT AND TRADEMARK OFFICE

CERTIFICATE OF CORRECTION

PATENT NO. : 7,743,847 B2
APPLICATION NO. : 10/380101
DATED : June 29, 2010
INVENTOR(S) : Hugh Edward Fisher It is certified that error appears in the above-identified patent and that said Letters Patent is hereby corrected as shown below:

** Column 9; Line 26; replace “Be” with --B'.--

Signed and Sealed this

Seventh Day of December, 2010

David J. Kappos

David J. Kappos
*Director of the United States Patent and Trademark Office*